United States Patent [19]

Deno

[11] Patent Number: 4,494,366

[45] Date of Patent: Jan. 22, 1985

[54] YARN END UNTWISTING DEVICE FOR A PNEUMATIC YARN SPLICING DEVICE

[75] Inventor: Koji Deno, Shiga, Japan

[73] Assignee: Murata Kikai Kabushiki Kaisha, Kyoto, Japan

[21] Appl. No.: 466,725

[22] Filed: Feb. 15, 1983

[30] Foreign Application Priority Data

Feb. 18, 1982 [JP] Japan ..... 57-21995[U]

[51] Int. Cl.[3] ..... D01H 15/00

[52] U.S. Cl. ..... 57/22

[58] Field of Search ..... 57/22, 261, 263

[56] References Cited

U.S. PATENT DOCUMENTS 4,263,775 4/1981 Mima ..... 57/22

4,397,140 8/1983 Sheehan et al. ..... 57/22

*Primary Examiner*—Donald Watkins

*Attorney, Agent, or Firm*—Spensley, Horn, Jubas & Lubitz

[57] ABSTRACT

A yarn end untwisting device for a pneumatic yarn splicing apparatus for spun yarns. Both yarn ends are guided into individual nozzle hole of the untwisting device and applied a pressurized fluid against each yarn end within the nozzle hole to open and loosen the component fibers of the yarn end. In the present device, the quantity of the pressurized fluid and the direction of jetting fluid can be changed and adjusted easily.

12 Claims, 9 Drawing Figures

YARN END UNTWISTING DEVICE FOR A PNEUMATIC YARN SPLICING DEVICE

BACKGROUND OF THE INVENTION

A pneumatic yarn splicing device is known by U.S. Pat. No. 4,263,775.

In splicing yarn ends of spun yarns by means of the pneumatic yarn splicing device, it is necessary to untwist both yarn ends for a predetermined length prior to splicing by means of a yarn end untwisting device. Such a yarn end untwisting device guides both yarn ends into individual nozzle holes and applys a pressurized fluid against each yarn end within the corresponding nozzle hole to open or loosen the component fibers of the yarn end. In such an yarn end untwisting operation, the quantity of the pressurized fluid jetted against the yarn ends and the direction of jetting the pressurized fluid have to be changed and adjusted appropriately corresponding to the characteristics of yarns, namely, the thickness and the length of the component fibers and the number of twist per unit length. The fine adjustment of the quantity and the jetting direction of the pressurized fluid is essential to achieve appropriate untwisting, whereas the simple adjustment of the quantity of the pressurized fluid by means of a valve is insufficient to achieve satisfactory untwisting.

SUMMARY OF THE INVENTION

The present invention relates to a yarn end untwisting device for a pneumatic yarn splicing device.

An object of the present invention is to provide an improved yarn end untwisting device inwhich the quantity and the jetting direction of a pressurized fluid jetted against yarn ends to untwist various yarn ends can be changed readily and quickly to achieve satisfactory yarn end untwisting.

In order to attain such an object, the shape of the pressurized fluid jet opening of the present device can selectively changed in various shapes, more practically, untwisting pipes having pressurized fluid jet openings of a variety of shapes suitable to a variety of yarn ends, respectively, are prepared beforehand for untwisting a variety of yarn ends and the untwisting pipes having the pressurized fluid jet openings of a variety of shapes are selectively inserted into the nozzle hole to control the jetting of the pressurized fluid by means of the jet opening. The term "shape" as used for explaining the function of the shape of the pressurized fluid jet opening hereinbefore, implies, not only the morphology proper, but also the size and the direction of the opening.

PREFERRED EMBODIMENTS OF THE INVENTION

Embodiments of the device will be described hereinafter with reference to appended drawings.

Figure 1:
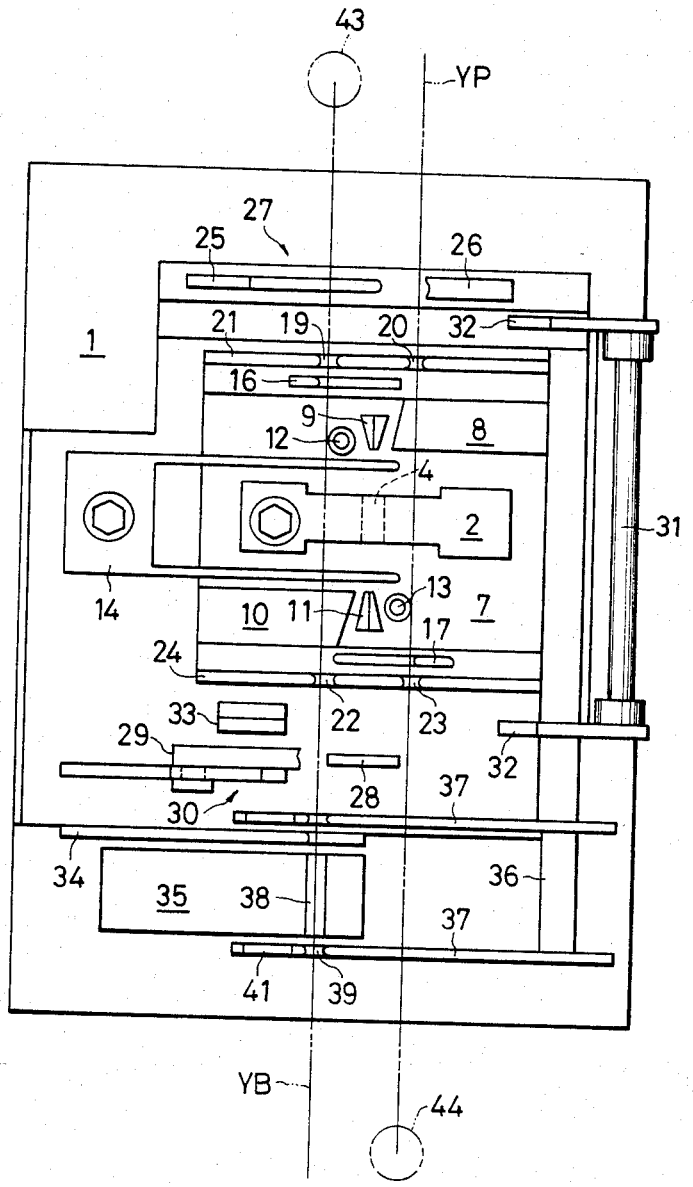
FIG. 1 is a front elevation of a pneumatic yarn splicing device.
Figure 2:
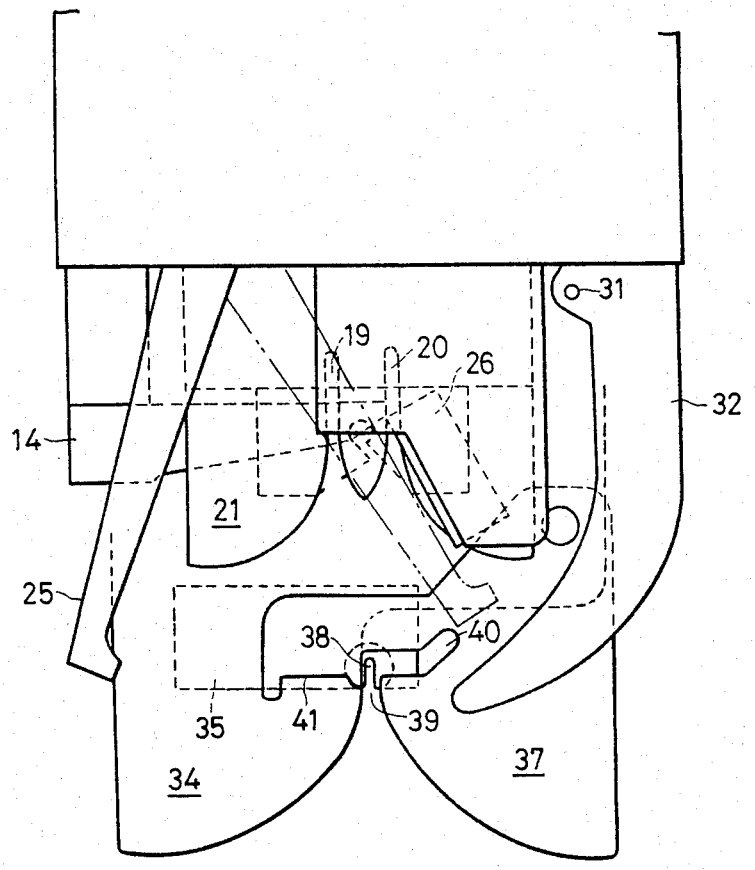
FIG. 2 is a plan view of the device of FIG. 1.

FIGS. 1 and 2 are a front elevation and a plan view, respectively, of a pneumatic yarn splicing device 1 as mounted on an automatic winder. A yarn splicing member 2 disposed in the central part of the device has a yarn splicing hole 4 connecting with a slit 3 opening in the front as show in FIG. 3. Air is jetted from a jetting nozzle 5 into the yarn splicing hole 4 to splice yarn ends. A conduit pipe 6 is connected to a pressurized air source, not shown. The yarn splicing member 2 is fastened to a bracket 7 with a screw. The bracket 7 has yarn guides 8, 9, 10 and 11. Yarn end untwisting nozzles 12 and 13 are opening into the bracket 7. The yarn splicing member 2 is inserted between yarn pressing levers 14, which serve to put yarns into the yarn splicing hole 4. The yarn pressing levers 14 are turned by pulling a rod, not shown, attached to the base part of the yarn pressing levers 14. Each of yarn cutting devices 16 and 17 has a stationary blade and a movable blade and is operated by pulling a lever, not shown, connected to the movable blade. A forked guide 21 having guide grooves 19 and 20 and a forked guide 24 having guide grooves 22 and 23 are disposed near the cutting devices 16 and 17 respectively. A package side yarn end clamping device 27 comprising a turning lever 25 and a clamping plate 26 is disposed above the forked guide 21, while a bobbin side yarn end clamping device 30 comprising a lever 28 and a movable clamping plate 29 is disposed below the forked guide 24. A pair of yarn handling levers 32 supported pivotally on a shaft 31 are disposed at the right hand of the yarn splicing member 2. A stopper for stopping the yarn handling lever 32 is indicated at 33. A detecting device 35 attached to a stationary guide plate 34 is disposed under the bobbin side yarn end clamping device 30. The detecting device 35 inspects a yarn to be spliced and a yarn running therethrough during normal winding operation. A pair of changing levers 37 pivotally supported on a shaft 36 are disposed so as to receive the stationary guide plate 34 and the detecting device 35 therebetween. A guide groove which can be aligned with the yarn passage 38 of the detecting device 35, an escape groove 40 connecting with the guide groove 39 and a hook 41 are formed in each of the changing levers 37.

Figure 3:
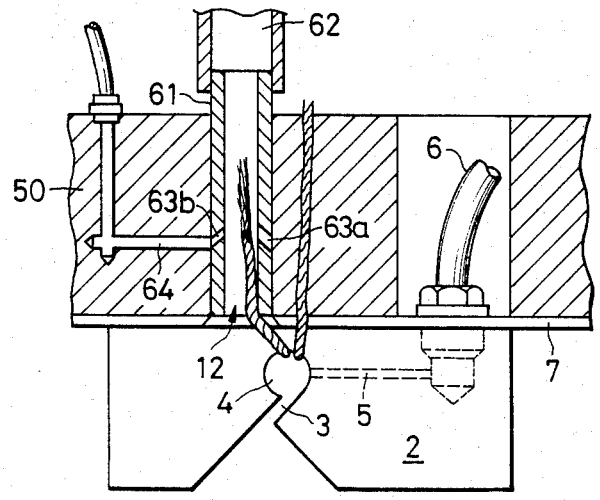
FIG. 3 is an enlarged sectional view of the nozzle hole and the peripheral part thereof.
Figure 4:
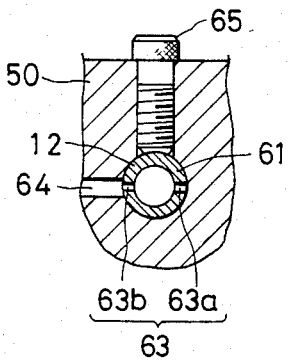
FIG. 4 is a sectional view of an untwisting pipe.

Since the nozzle holes 12 and 13 are identical in shape, only the nozzle hole 12 will be described. Referring to FIGS. 3 and 4, the nozzle hole 12 is drilled in a block 50. A tubular yarn end untwisting pipe 61 is fitted axially slidably and rotatably in the nozzle hole 12. The untwisting pipe 61 is connected to a flexible pipe 62 connecting to a suction pipe, not shown. A plurality of jetting holes 63 directed inward of the untwisting pipe 61 are formed diagonally near the open end of the untwisting pipe 61. The jetting holes 63 have different inclinations and different diameters. The jetting holes 63 are selectively connected to a fluid passage 64 one at a time by properly turning the untwisting pipe 61. In an example of the untwisting pipe 61 shown in FIG. 4, two jetting holes 63*a* and 63*b* are formed in the untwisting pipe 61 practically in the same imaginary plane, however, when many jetting holes are formed in the untwisting pipe 61, those jetting holes may be formed in a plurality of imaginary planes. After the untwisting pipe 61 has been turned or slided to an appropriate position, the untwisting pipe 61 is fixed at the position with a setscrew 65. The fluid passage 64 is connected to a pressurized conduit pipe, not shown.

The manner of yarn splicing operation of the present device will be described hereinafter.

When the detecting device 35 for detecting yarn end breakage or the exhaution of yarn layers formed on a bobbin detects the interruption of running of a yarn during winding operation, the winding operation is interrupted and yarn splicing operation is started. Paired package side and bobbin side suction arms 44 and 43 suck in a package side yarn end YP and a bobbin side yarn end YB, respectively, and turn to introduce the yarn ends into the yarn splicing device 1. The paired suction arms 44 and 43 turn individually; first the package part suction arm 44 sucks in the package side yarn end YP, turns toward the yarn splicing device 1 and stops at a position outside of the yarn splicing device 1, then, after a predetermined period of time, the bobbin side suction arm 43 sucks in the bobbin side yarn end YB, turns toward the yarn splicing device 1 and stops at a position outside of the yarn splicing device 1. Within an interval between the completion of operation of the package side suction arm 44 and the start of operation of the bobbin side suction arm 43, the turning lever 25 of the package side yarn clamping device 27 operates to place the yarn YP between the turning lever 25 and the clamping plate 26 and to bring the yarn YP to the stationary guide plate 34 disposed adjacently to the detecting device 35 and to the guide groove 39 of the changing lever 37. After the detecting device 35 has inspected the yarn YP, the changing lever 37 turns on a shaft 36 to remove the yarn YP from the detecting device and to guide the yarn YP into the escape groove 40. Then, the bobbin side suction arm 43 sucks in the bobbin side yarn YB, turns toward the yarn splicing device 1 and stops at a position outside of the yarn splicing device 1. During such operation of the bobbin side suction arm 43, the yarn YB is guided to a position between the lever 28 of the bobbin side clamping device 30 and the clamping plate 29 via the hook 41 of the changing lever 37.

After the completion of the operation of the bobbin side suction arm 43 and the package side suction arm 44, the yarn handling levers 32 turns on the shaft 31 to guide the bobbin side yarn YB into the guide groove 19 of the forked guide 21, the splicing hole 4 of the yarn splicing member 2, a groove formed between the yarn guides 10 and 11 and the guide groove 22 of the forked guide 24 and to guide the package side yarn YP into the guide groove 20 of the forked guide 21, a groove formed between the yarn guides 8 and 9, the splicing hole 4 of the yarn splicing member 2 and the guide groove 23 of the forked guide 24. Then, the turning lever 25 of the package side clamping device 27 is pressed against the clamping plate 26 to clamp the package side yarn YP and the clamping plate 29 of the bobbin side clamping device 30 is pressed against the lever 28 to clamp the bobbin side yarn YB.

After the yarns YP and YB have been clamped the levers of the yarn cutting devices 16 and 17 are pulled to actuate the yarn cutting devices 16 and 17 so as to cut the corresponding yarns at the respective predetermined positions with respect to the bobbin side clamping device 30 and the package side clamping device 27.

The nozzle holes 12 and 13 are activated in synchronism with the yarn cutting operation to suck the cut yarn ends into the nozzle holes 12 and 13 as shown in FIG. 3. Then, the yarn handling levers 32 are retracted to allow the yarn ends to be sucked further into the nozzle holes 12 and 13. The sucking action of the nozzle hole 12 is caused by the suction effect of the flexible pipe 62 connected to the untwisting pipe 61. At the same time, a pressurized fluid is jetted from the jetting hole 63 drilled in the untwisting pipe 61 into the untwisting pipe 61 through the fluid passage 64 formed in the block 50 to untwist and loosen the yarn end sucked in the untwisting pipe 61. The flexible pipe 62 may be omitted and the yarn end may be sucked into the untwisting pipe 61 by the agency of the pressurized fluid jetted through the fluid passage 64. In untwisting the yarn end, the optimum quantity of pressurized fluid has to be jetted against the yarn end taking into consideration the thickness of the yarns to be spliced and the fiber length of the component fibers of the yarns. In order to apply the optimum quantity of the pressurized fluid into the untwisting pipe 61, the setscrew 65 screwed in the block 50 to stop the untwisting pipe 61 is loosened to make the untwisting pipe 61 free, then the optimum jetting hole 63 among a plurality of jetting holes formed in the untwisting pipe 61 is selectively brought into coincidence with the fluid passage 64, the setscrew 65 is fastened again and then the pressurized fluid is jetted from the jetting hole 63.

Since the untwisting pipe 61 is axially slidable with respect to the block 50, the direction and the quantity of the pressurized fluid jetted through the jetting hole 63 may be changed by adjusting the axial position of the untwisting pipe 61. When the jetting direction and the quantity of the pressurized fluid is changed, the position where the pressurized fluid encounter the yarn end is changed. Consequently, the length of the untwisted part of the yarn end and the degree of untwisting are changed. When the untwisting pipe 61 is inserted less deep into the nozzle hole, the jetted pressurized fluid is supplied to the yarn end at the relatively upper part thereof, so that longer part of the yarn end is untwisted and the free end of the yarn end is tapered in a hairy state. When thus untwisted yarn ends are spliced up, a bad joint is formed and neps are liable to be formed. On the other hand, when the untwisting pipe 61 is inserted deep into the nozzle hole, the jetted pressurized fluid encounter the yarn end near the free end thereof, so that shorter part of the yarn end is untwisted and a weak joint or a thick joint is formed. Accordingly, the axial position of the untwisting pipe 61 is adjusted according to the type of yarn and yarn count to be processed to provide a satisfactory untwisted state of yarn ends.

At the moment of or in synchronism with the interruption of the sucking action of the nozzle holes 12 and 13 after the yarn ends YB and YP have been untwisted in a state suitable for yarn splicing, the yarn handling levers 32 advance again to draw out the corresponding yarn ends YP and YB from the nozzle holes 12 and 13 and to arrange the yarn ends YP and YB in parallel in the yarn splicing hole 4. Then, the pressurized fluid is jetted from the jetting nozzle 5 against the yarn ends YP and YB. Since both yarn ends YP and YB are overlapped, the pressurized fluid causes the component fibers to entangle with each other to form an initial fiber entanglement. After the initial fiber entanglement has been formed, the yarns YB and YP are moved in a single yarn through the interior of the yarn splicing hole 4 while the fiber entanglement is promoted and thereby the yarn splicing is completed.

Upon the completion of the yarn splicing operation, the package side clamping device 27 and the bobbin side clamping device 30 release the yarns YP and YB, respectively, which have now been spliced together in a single yarn, the yarn pressing lever 14 and the yarn handling levers 32 are retracted to release the yarn from the yarn splicing device 1, so that the yarn is allowed to return to the normal winding position and the winding operation is restarted.

Another embodiment of the present yarn end untwisting device will be described hereinafter.

Figure 5:
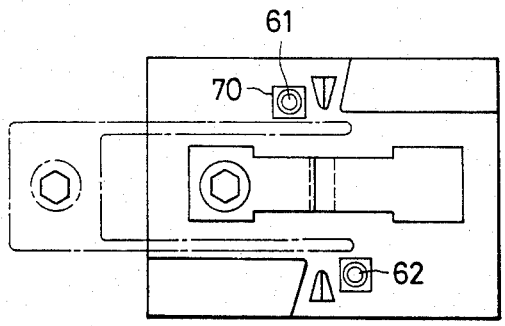
FIG. 5 is a front elevation of the essential part of another embodiment of the pneumatic yarn splicing device of the present invention.
Figure 6:
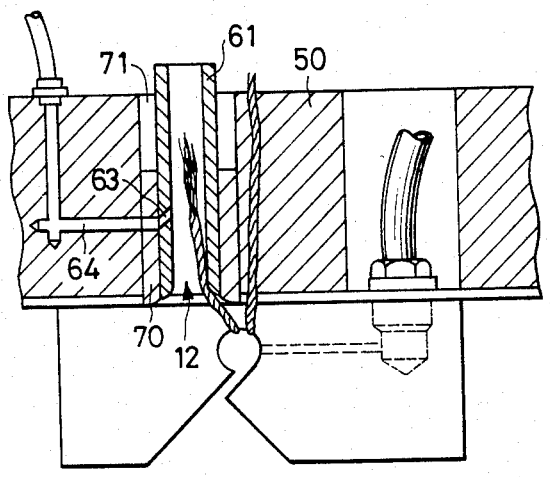
FIG. 6 is an enlarged sectional view of the nozzle hole of the device of FIG. 5.
Figure 7:
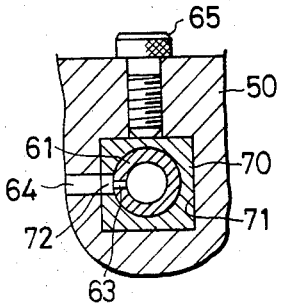
FIG. 7 is a sectional view of an untwisting pipe of the device of FIG. 5, and FIGS. 8 and 9 are sectional views of different untwisting pipes.
Figure 8:
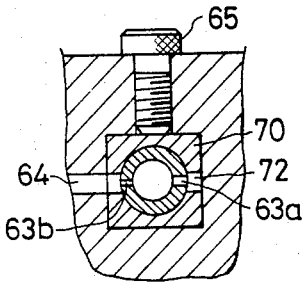
Figure 9:
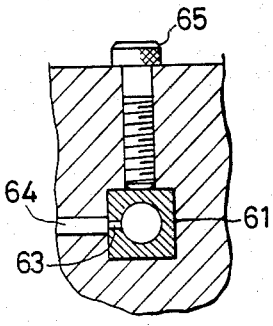

The essential part of a yarn splicing device 1 is shown in FIG. 5. Untwisting pipes 61 and 62 are secured within yarn end control blocks 70 of the shape of a square bar. The yarn end control block 70 is detachably fitted in a square bore 71 and fixed thereto with a setscrew 65 screwed against one side of the yarn end control block 70. The respective configurations of the yarn end control block 70 and the square bore 71 are designed so as to make the jetting hole 63 coincide with a fluid passage 64 when the yarn end control block 70 is fitted in the square bore 71. A through hole 72, by means of which the fluid passage 64 communicates with the jetting hole 63, is formed in the yarn end control block 70. A plurality of such yarn end control blocks 70 incorporating untwisting pipes 61 having jetting holes 63 of different shapes, respectively, are prepared and those yarn end control blocks 70 are used selectively according to the characteristics of yarns to be untwisted. The replacement of the yarn end control block 70 can readily be carried out by loosening the setscrew 65. Since the yarn end control blocks 70, as well as the square bore 71, are formed in the identical shape of a square bar, any jetting hole 63 can readily be aligned with the fluid passage 64. A plurality of sets of a through hole of the block and different jetting hole may be formed each faces of the control block. Two through holes 72 and two jetting holes **63*a* and 63*b* may be formed in the respective right-hand and left-hand sides of a yarn end control block 70 and an untwisting pipe 61 secured within the yarn end control block 70, respectively, as shown in FIG. 8 and the different jetting holes 63*a* and 63*b* may selectively be brought in alignment with the fluid passage 64 by extracting the yarn end control block 70 from the square bore 71, properly turning the yarn end control block 70 to change the working side and then fitting the yarn end control block 70 again in the square bore 71. FIG. 9 shows an untwisting pipe 61 and a yarn end control block 70** which are formed in a unitary member. The present device includes all those yarn end control blocks and untwisting pipes.

In the present device, a fluid passage opening formed in the side wall of a yarn end untwisting nozzle hole may be selectively changed in an area of the jetting hole by selecting and inserting an untwisting pipe having a desirable jetting hole so as to be aligned with the opening of the fluid passage, or changed in a position by turning or sliding the untwisting pipes in the nozzle hole, whereby yarn end untwisting operation is carried out under the optimum condition. All those various constitutions and modifications as described hereinbefore are included in the present device.

It is apparent from what has been described hereinbefore, that, according to the present device, the quantity and the jetting direction of a pressurized fluid jetted against yarn ends can selectively and properly be determined according to the thickness of spun yarns to be spliced up or the length and other characteristics of the component fibers of those spun yarns and hence the yarn ends are satisfactorily untwisted, so that reliable yarn splicing operation is ensured.

What is claimed is:

1. A yarn end untwisting device for a pneumatic yarn splicing device, comprising a splicing block having a tubular nozzle hole, a tubular untwisting pipe insertable into the tubular nozzle hole, the untwisting pipe having one or more jetting holes of a predetermined shape formed therein, and a fluid passage formed in the splicing block, the fluid passage opening into the nozzle hole for jetting a pressurized fluid into the nozzle hole, wherein the amount or direction of the pressurized fluid jetting into the nozzle hole can optionally be changed by inserting the untwisting pipe into said nozzle hole so that a selected one of said jetting holes communicates with said fluid passage.

2. A yarn end untwisting device as claimed in claim 1, wherein said untwisting pipe has a central longitudinal axis and is slidable and rotatable within the nozzle hole and wherein said jetting holes each have a different inclination with respect to the central longitudinal axis and a different diameter.

3. A yarn end untwisting device as claimed in claim 2, wherein said jetting holes are formed in the untwisting pipe in the same imaginary plane.

4. A yarn end untwisting device as claimed in claim 2, wherein said jetting holes are formed in different imaginary planes.

5. A yarn end untwisting device as claimed in claim 2, 3 or 4, wherein said untwisting pipe is fixed at a position in the nozzle hole with a setscrew.

6. A yarn end untwisting device as claimed in claim 1, further including a yarn end control block, said untwisting pipe being secured within the yarn end control block, the yarn end control block being detachably fitted in a bore formed in the splicing block, the yarn end control block having at least one through hole being able to communicate with both a jetting hole and the fluid passage.

7. A yarn end untwisting device as claimed in claim 6, wherein said yarn end control block and bore are square-shaped and wherein said yarn end control block is detachably fitted in the splicing block by a setscrew.

8. A yarn end untwisting device as claimed in claim 6 or 7, wherein the untwisting pipe has a control longitudinal axis and includes a plurality of jetting holes each having a different inclination with respect to the axis and a different diameter and wherein the yarn end control block includes through holes for communicating a selected one of the jetting holes with the fluid passage.

9. A yarn end untwisting device as claimed in claim 6, or 7, wherein said untwisting pipe and yarn end control block are formed in a unitary member.

10. A yarn end untwisting device for a yarn splicing apparatus comprising a splicing block having a tubular nozzle hole and a fluid passage opening into the side wall of the nozzle hole for jetting pressurized fluid into the nozzle hole and further including an untwisting pipe insertable into the nozzle hole, and said pipe having one or more jetting holes which can be aligned with the fluid passage opening into the side wall of the fluid nozzle to vary the jetting action in said nozzle.

11. A yarn end untwisting device for a pneumatic yarn splicing apparatus comprising:

a block having first and second ducts formed therein;

a pipe which is insertable into the first duct and into which a pressurized fluid is jetted through the second duct, at least one hole being formed in the wall of the pipe; and securing means for fixing the pipe in the first duct so that by selectively aligning one of the pipe holes with the second duct, the jetting action of the fluid in the pipe is varied.

12. A device for facilitating the untwisting of yarn ends, the device being a component of a yarn splicing apparatus, the untwisting device comprising:

a splicing block having a fluid duct and a linear duct for receiving a yarn end untwisting block, the fluid duct having first and second ends, the first end of the fluid duct coupled to a pressurized fluid source for supplying jetting fluid to a yarn end untwisting pipe, the second end of the fluid duct opening into the linear duct;

a yarn end untwisting block insertable into the splicing block linear duct, the yarn end untwisting block having a linear passageway which is positioned parallel to the splicing block linear duct when the yarn end untwisting block is inserted into the splicing block linear duct, the yarn end untwisting block having at least one opening which can be positioned so that when the yarn end untwisting block is inserted into the splicing block linear duct, fluid can pass from the fluid duct into the yarn end untwisting block passageway; and a yarn end untwisting pipe insertable into the yarn end untwisting block passageway, the pipe having at least one side hole that can be aligned with both the fluid duct second end opening and at least one yarn end untwisting block opening when the yarn end untwisting pipe is inserted into the yarn and untwisting block passageway, wherein changing the diameter of the pipe side hole or changing the angle in which the fluid enters the pipe varies the jetting action within the pipe.

* * * * *